US009909762B2

(12) United States Patent
Emiliani

(10) Patent No.: US 9,909,762 B2
(45) Date of Patent: Mar. 6, 2018

(54) GAS BURNER FOR A COOKING HOB

(71) Applicant: DEFENDI ITALY S.R.L., Camerano (IT)

(72) Inventor: Girolamo Emiliani, Camerano (IT)

( * ) Notice: Subject to any disclaimer, the term of this patent is extended or adjusted under 35 U.S.C. 154(b) by 0 days.

(21) Appl. No.: 15/110,395

(22) PCT Filed: Jan. 12, 2015

(86) PCT No.: PCT/IB2015/050226
§ 371 (c)(1),
(2) Date: Jul. 7, 2016

(87) PCT Pub. No.: WO2015/107448
PCT Pub. Date: Jul. 23, 2015

(65) Prior Publication Data

US 2016/0327277 A1 Nov. 10, 2016

(30) Foreign Application Priority Data

Jan. 14, 2014 (IT) ..... VE2014A0003

(51) Int. Cl.
*F24C 3/08* (2006.01)
*F23D 14/06* (2006.01)
*F23D 14/26* (2006.01)

(52) U.S. Cl.
CPC ..... *F24C 3/082* (2013.01); *F23D 14/06* (2013.01); *F23D 14/26* (2013.01); *F23D 2900/14062* (2013.01)

(58) Field of Classification Search
CPC ..... F24C 3/082
USPC ..... 126/39 E, 39 BA, 39 R; 431/278, 328, 431/266, 354
See application file for complete search history.

(56) References Cited

U.S. PATENT DOCUMENTS 5,865,615 A * 2/1999 Simpson ..... F24C 3/085 126/39 H
6,146,132 A * 11/2000 Harneit ..... F23D 14/06 126/39 E
6,589,046 B2 * 7/2003 Harneit ..... F23D 14/06 126/39 BA
2001/0010897 A1 8/2001 Dane

FOREIGN PATENT DOCUMENTS

EP 0945681 A1 9/1999
JP 2008202866 A 9/2008

* cited by examiner

*Primary Examiner* — Avinash Savani
(74) *Attorney, Agent, or Firm* — Themis Law

(57) ABSTRACT

A gas burner for cooking equipment, such as a cooking hob, includes a supporting cup-shaped injector holder fixable in a position corresponding to an opening in the cooking hob in which the burner is to be installed, a flame divider resting on the cup-shaped support to define, with its outer circumferential rim and with the surface of the cooking hob in which the burner to be installed, a passage for the entry of a flow of primary air, a sheet metal cover removably resting on the flame divider and defining therewith a distribution chamber for the combustion mixture of gas and primary air, wherein the distribution chamber is bounded by a raised band, in which radial slots are provided for passage of the combustion mixture, the cover having apertures facing the radial slots and cooperating therewith to define the inclination of the flames emerging from the apertures.

20 Claims, 2 Drawing Sheets

GAS BURNER FOR A COOKING HOB

Figure 1:
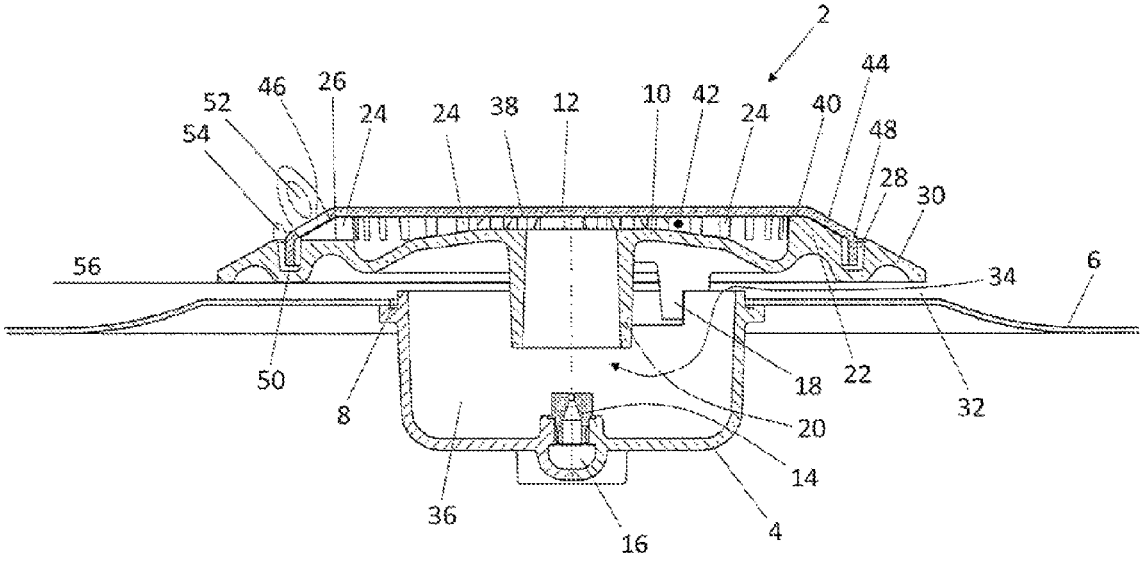

The present invention relates to an improved gas burner for cooking equipment.

Gas burners are known, constructed in different sizes (small, medium and large) for installation in kitchens and cooking hobs in general.

They generally consist of three separate elements:

a cup-shaped injector holder made of die-cast aluminium and carrying applied to its base an injector of vertical axis connectable to the gas inlet, a flame divider, also made of die-cast aluminium, presenting in its centre a frusto-conical conduit coaxial to the injector, and having its outer edge raised and provided with a plurality of radial recesses for exit of the gas and primary air mixture, a dish-shaped cover, made of enameled aluminium and intended to rest on the flame divider; in particular, it projects from the edge of the flame divider with the purpose of upperly closing the radial recesses provided therein.

These burners operate with primary air which is drawn from above the cooking hob and enters the burner by passing through slots defined between the lower base of the flame divider and the cooking hob.

In some cases, the cooking hob also comprises a multi-ring burner of greater diameter than the others and generally having two or three rings of concentric flames. A multi-ring burner usually consists of an injector holder element, an aluminium flame divider comprising an outer annular portion and an inner circular portion, and two closure covers, one for each flame divider portion.

All traditional burners, whether of single ring or multi-ring type, are substantially of cylindrical mushroom shape given the size of the cover, which projects to a more or less accentuated amount from the outer edge of the flame divider.

This type of design is particularly widespread, and consequently there is always the need to create different forms in order to offer to the public a burner clearly distinctive compared with others.

In particular, current market requirements are increasingly aimed at small-thickness cooking hobs, which consequently requires that the burners associated with them be of small height, i.e. nearly in line with the upper sheet metal of the cooking hob.

Burners are also known with their cover made of sheet metal, in which apertures are provided for exit of the combustion mixture. In this manner it is the cover itself which also acts as the flame divider and in addition to enabling a reduction in the overall height of the entire burner, it can be enameled and can hence be more easily cleaned than aluminium.

However, a combined cover-flame divider made of sheet metal must have a fairly small thickness, and though on the one hand this is advantageous by being of low cost and allowing the apertures to be produced by punching and drawing, on the other hand it is disadvantageous in that the small thickness of the apertures themselves does not enable the flames to be properly directed, in particularly when the edge in which the apertures are formed is fairly inclined and the just formed flames become positioned substantially vertical. This means that the grid on which the pan is rested has to be spaced from the burner, with a negative impact on the cooking hob design and a large reduction in burner efficiency.

Moreover the small axial extension of the apertures provided in the cover can involve the risk of flame return if using liquefied gas.

EP 945681 describes a cooking appliance comprising a burner installable in a cooking hob made from glass-ceramic. In particular, this burner comprises only a cup-shaped support and a cover, without any flame divider; in detail, the gas exit passages are provided directly in the cover or, alternately, in the collar of the cup-shaped support (i.e. there is no provision for an embodiment in which the gas passages are in both the cover and in the collar of the cup-shaped support). In addition, the cover of this burner can be made of enameled cast aluminium or preferably of glass-ceramic.

An object of the invention is to propose a burner of small height and having a pleasant appearance, in addition to being highly distinctive compared with commercially available traditional burners.

Another object of the invention is to provide an improved gas burner of high efficiency.

Another object of the invention is to provide an improved gas burner which does not present flame return with liquefied gas.

Another object of the invention is to provide an improved gas burner which is obtainable in a simple, rapid and low-cost manner.

All these objects and others which will be apparent from the ensuing description are attained, according to the invention, by an improved burner with the characteristics indicated in claim 1.

Figure 2:
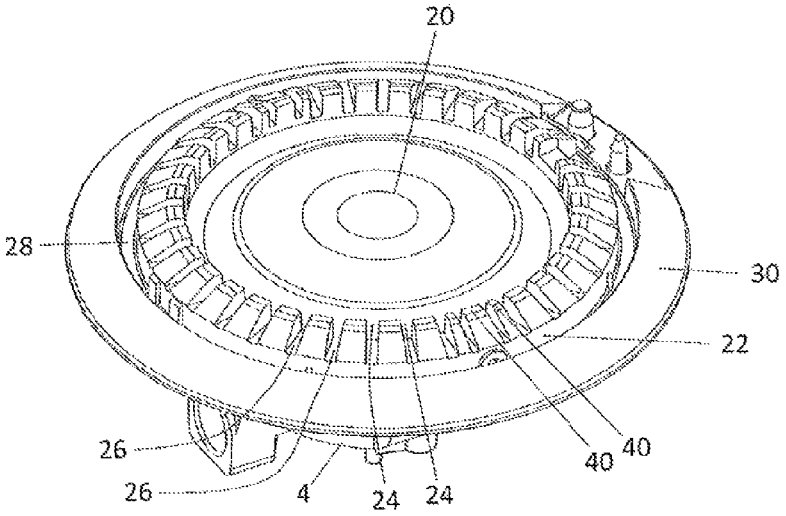
Figure 3:
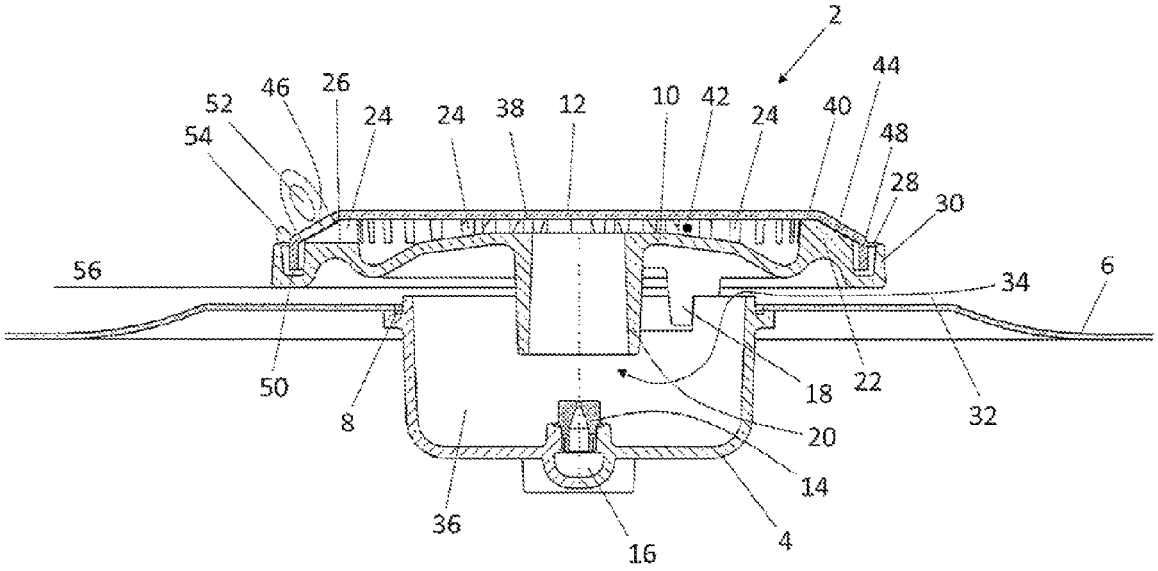
Figure 4:
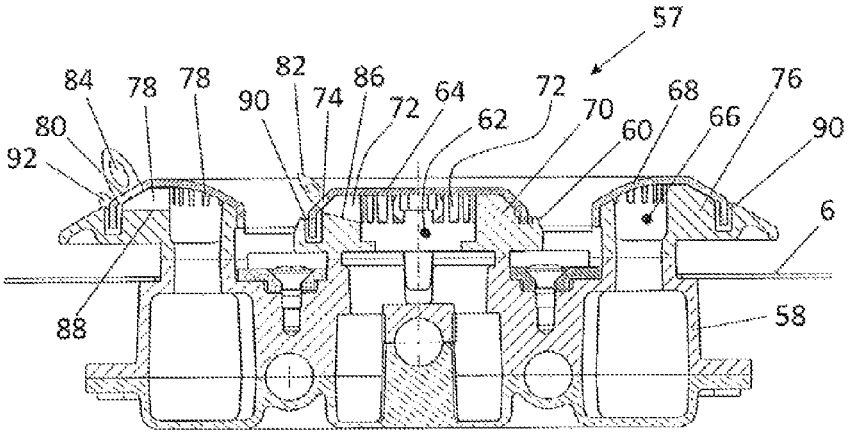

The present invention is further clarified in two preferred embodiments thereof with reference to the accompanying drawings, in which:

FIG. 1 is a vertical section through a single-ring burner according to the invention, applied to a cooking hob, FIG. 2 is a perspective view thereof without the cover, FIG. 3 shows it in the same view as FIG. 1, but as a different embodiment, FIG. 4 shows a double-ring burner according to the invention in the same view as FIG. 1.

As can be seen from Figures from 1 to 3, the burner 2 according to the invention comprises a cup-shaped support 4 fixed to the upper sheet metal of a cooking hob 6, in a position corresponding with an opening 8 provided therein.

The burner 2 also comprises a flame divider 10 and a cover 12 which mutually cooperate to together define a distribution chamber for the combustion mixture.

At the centre of the base of the cup-shaped support 4 an injector 14 of vertical axis is applied and is connected to a gas inlet (not shown) via a conduit 16.

The flame divider 10 rests on the cup-shaped support 4 via centring lugs 18 and centrally presents a frusto-conical conduit 20 of vertical axis, coaxial to the injector 14. The flame divider 10 also comprises a raised annular band 22, provided with a plurality of radial slots 24, lowerly bounded by a surface 26 for directing the flames.

External to the raised annular band 22 provided with the radial slots 24 in the flame divider 10, an annular slot 28 is provided bounded by an inclined outer rim 30. In detail, the lower part of the outer rim 30 defines with the underlying sheet metal 6 of the cooking hob a passage 32 for entry of primary air 34 into the inner chamber 36 of the cup-shaped support 4.

The cover 12 is rested on the flame divider 10 and is of discoidal shape with a C-shaped diametrical cross-section (see FIG. 1). In detail, the cover 12 comprises a central portion 38 which rests with its lower circumferential edge on the horizontal inner circumferential edge 40 of the raised band 22 of the flame divider 10 to define therewith a radial venturi effect chamber 42.

The central portion 38 of the cover 12 extends to the outside as an (annular) circumferential band 44 inclined to match the inclination of the raised band 22 of the flame divider 10. This inclined band 44 of the cover 12 is provided with a plurality of radial apertures 46 defined such as to face the corresponding radial slots 24 of the raised band 22 of the flame divider 10.

Preferably, the annular band 44 of the cover 12 and the underlying surface of the raised band 22 are inclined by an angle substantially between 15° and 45°, preferably about 30° to a horizontal plane 56, and consequently the radial apertures 46 of the cover 12 have the axis (which traverses them) inclined by an angle substantially between 45° and 75°, preferably 60°, to said horizontal plane 56. In addition, preferably the surface 26 which lowerly bounds the radial slots 24 is substantially horizontal (i.e. substantially parallel to said plane 56).

The inclined annular band 44 of the cover 12 extends as a substantially cylindrical terminal band of vertical axis 48, which is inserted into the annular slot 28 of the flame divider 10, defining with this latter a continuous passage 50 of U cross-section and extending for the entire circumferential extension of the slot 28.

The burner according to the invention operates in the following manner.

The gas stream leaving the injector 14 draws a flow of primary air 34 through the passage bounded upperly by the outer rim of the flame divider 10 and lowerly by the sheet metal 6 of the cooking hob, and entrains it along the conduit 20 to the interior of radial venture effect chamber 42, hence causing them to mix.

The mixture of gas and primary air then passes through the radial slots 24 of the flame divider 10 to emerge through the radial apertures 45 of the cover 12, hence generating a ring of main flames 52 of inclination essentially related to the inclination of the axis of said apertures 46 and to the inclination of the surface 26 lowerly bounding the radial slots 24.

Preferably, part of the mixture of gas and primary air also emerges through the continuous annular passage 50, hence generating at the annular slot 28 a continuous stabilization flame 54.

The purpose of the surfaces 26 which lowerly bound the radial slots 24 is to direct the combustion mixture flow leaving these slots and hence the flames 52.

More particularly, the gas and primary air flows which emerge from the slots 24 are guided by the surfaces 26 and if, in particular, these are horizontal, they tend to horizontally direct these flows and the flames 52 which they generate. In this manner, if these surfaces 26 are made inclined, the inclination of the flames 52 can be modified, and experimental tests carried out have shown that for example with apertures 46 with their axis inclined by 60° to the horizontal surfaces 26, flames 52 can be obtained inclined at about 40-45° to the horizontal. Evidently, varying the inclination of the surfaces 26 will vary the inclination of the flames 52, which in any event are deviated from the direction which they would have if the slots 24 and their lower bounding surfaces 26 were absent.

The inclination of the flames 52 can also be varied by varying the radial extension of the surfaces 26, i.e. the inner diameter of the annular slots 28.

The embodiment of FIG. 3 represents a burner with a single ring of flames having the same aforedescribed characteristics relative to the burner of FIGS. 1 and 2, with the exception of the fact that the outer rim of the flame divider 10 is not inclined and does not extend outwards, but terminates substantially at the annular slot 28.

The embodiment of FIG. 4 represents a burner according to the invention in the multi-ring version, more specifically in the double-ring version. It presents substantially the aforedescribed characteristics relative to the burner with a single ring of flames represented in Figures from 1 to 3, these characteristics being evidently suitably adapted for a burner arranged to generate two separate frame rings, one central and one concentric thereto.

In detail, the double-ring burner 57 comprises an injector holder support 58, on which a flame divider 60 rests. This comprises internally a central chamber 62, closed upperly by a sheet metal circular cover 64, and an annular chamber 66, closed upperly by a sheet metal annular cover 68.

The central chamber 62 is defined by a raised band 70, in which a plurality of radial slots 72 are provided, facing corresponding apertures 74 provided in the circular cover 64.

The annular chamber 66 is also bounded externally by a raised band 76, in which a plurality of radial slots 78 are provided, facing corresponding apertures 80 provided in the annular cover 68.

The shape of the raised band 70 of the central chamber 62 and of the raised band 76 of the annular chamber 66 is similar to the shape of the raised band 22 of the single-flame ring burner described with reference to Figures from 1 to 3, and the method of orientating the flames 82 and 84 emerging from the apertures 74 and 80 respectively being similar to that already described, by virtue of the interaction of the radial slots 72 and 78 provided in the raised bands 70 and 76 with the apertures 74 and 80 of the respective covers 64 and 68. In this respect, again in this case the radial slots 72 and 78 of the flame divider 60 are bounded lowerly by respective surfaces 86 and 88 for directing the flames 82 and 84, the inclination of the rings of flames 82 and 84 being essentially related to the inclination of the axis which perpendicularly traverses said apertures 74 and 80 and to the inclination of the surfaces 86 and 88 lowerly bounding the radial slots 72 and 78 respectively.

In particular, said surfaces 86 and 88 are disposed such that gas and primary air mixture flows leaving the radial slots 72 and 78 are deviated horizontally to hence generate flames 82 and 84 which define, with the horizontal, an angle which is less than that which the flames leaving the apertures 74 and 80 would define in the absence of the radial slots 72 and 78.

Also in the multi-ring burner of FIG. 4, the raised bands 70 and 76 preferably present annular grooves 90 for passage of a gas and primary air mixture and generation of annular stabilization flames 92.

In this burner the inclination of the flames 82 and 84 can also be varied by varying the inclination of the surfaces 86 and 88 or by varying the radial extension of the grooves 90, which can be particularly advantageous for gas combustion in the case of low grids or of invasive shape.

Independently of the particular embodiment, whether of single or multiple flame ring type, the radial slots 24, 72 and 78 can be in the form of holes or rectangular notches provided in the raised band 22, 70 and 76, which can be made integral with the remaining part of the flame divider 10, 60 or can be made as a separate annular element and applied to the flame divider.

Preferably, the sheet metal covers 12, 64 and/or 68 of the burner have a radial extension less than that of the flame divider 10 and/or 60 such that the outer circumferential rim 30 of this latter projects radially beyond the corresponding cover. Advantageously, the outer circumferential rim 30 of the flame divider 10 and/or 60 is inclined by an angle corresponding to the inclined circumferential band 44 of the covers 12, 64 and/or 68 such as to define a pleasing line continuity between these and the exposed portion of the flame divider.

Preferably, the covers 12, 64, 68 are made of pressed enamelable sheet metal. Advantageously, the covers 12, 64 and 68 are of blanked and dished sheet metal, preferably of steel, but also of aluminium, brass, stainless steel, sintered steel or other suitable metal alloys.

In any event, and independently of the particular burner embodiment, it is much more advantageous than traditional burners, and in particular:

it enables considerable flexibility of use, by being usable in those markets which also require mutually different flame inclinations, it enables a flat design; moreover the line continuity between the cover and the exposed portion of the flame divider gives the overall burner a particularly pleasant appearance, the fact that the cover is made of enamelable sheet metal makes it easily cleanable, the optimal flame inclination, even with a sheet metal cover, results in very low combustion values and very high efficiency, the small height of the pan resting grid enables very low cooking hobs to be constructed, the radial slots defined in the basic flame divider increase the axial extension of the passage recesses for the combustion mixture flow, hence preventing flame return even in the case of cover apertures of considerable dimensions, the cover construction is simple and economic.

The invention claimed is:

1. An improved gas burner (2, 57) for cooking equipment comprising:

a supporting cup-shaped injector holder (4, 58) adapted to be fixed in a position corresponding to an opening (8) provided in a cooking hob (6) in which said burner is intended to be installed;

a flame divider (10, 60) resting on said cup-shaped support (4, 58) in such a manner as to define, with an outer circumferential rim (30) of said cup-shaped support and with a surface of said cooking hob (6) in which said burner (2, 57) is intended to be installed, a passage (32) for entry of a flow of primary air (34); and at least one sheet metal cover (12, 64, 68) removably resting on said flame divider (10, 60) and defining therewith at least one distribution chamber (42, 62, 66) for a combustion mixture of gas and the primary air, wherein said distribution chamber (42, 62, 66) is bounded by a raised band (22, 70, 76), in which a plurality of radial slots (24, 72, 78) are provided for passage of said combustion mixture, said cover (12, 64, 68) comprising a plurality of apertures (46, 74, 80) facing said radial slots (24, 72, 78) and cooperating therewith to define an inclination of flames (52, 82, 84) emerging from said apertures (46, 74, 80), and wherein the inclination of the flames (52, 82, 84) emerging from the apertures (46, 74, 80) of said cover (12, 64, 68) is defined by an inclination of an axis which traverses said apertures (46, 74, 80) and by an inclination of a surface (26, 86, 88) lowerly bounding the radial slots (24, 72, 78) provided in said flame divider (10, 60).

2. The burner as claimed in claim 1, wherein the inclination of the flames (52, 82, 84) emerging from the apertures (46, 74, 80) of said cover (12, 64, 68) is further defined by a radial extension of the surface (26, 86, 88) lowerly bounding said radial slots (24, 72, 78) provided in said flame divider (10, 60).

3. An improved gas burner (2, 57) for cooking equipment comprising:

a supporting cup-shaped injector holder (4, 58) adapted to be fixed in a position corresponding to an opening (8) provided in a cooking hob (6) in which said burner is intended to be installed;

a flame divider (10, 60) resting on said cup-shaped support (4, 58) in such a manner as to define, with an outer circumferential rim (30) of said cup-shaped support and with a surface of said cooking hob (6) in which said burner (2, 57) is intended to be installed, a passage (32) for entry of a flow of primary air (34); and at least one sheet metal cover (12, 64, 68) removably resting on said flame divider (10, 60) and defining therewith at least one distribution chamber (42, 62, 66) for a combustion mixture of gas and the primary air, wherein said distribution chamber (42, 62, 66) is bounded by a raised band (22, 70, 76), in which a plurality of radial slots (24, 72, 78) are provided for passage of said combustion mixture, said cover (12, 64, 68) comprising a plurality of apertures (46, 74, 80) facing said radial slots (24, 72, 78) and cooperating therewith to define an inclination of flames (52, 82, 84) emerging from said apertures (46, 74, 80), and wherein the surface (26, 86, 88) lowerly bounding said radial slots (24, 72, 78) is inclined to such to define a direction which the flames (52, 82, 84) emerging from said apertures (46, 74, 80).

4. The burner as claimed in claim 1, wherein the surface (26, 86, 88) lowerly bounding said radial slots (24, 72, 78) provided in said flame divider is substantially horizontal.

5. The burner as claimed in claim 1, wherein an axis which traverses perpendicularly said apertures (46, 74, 80) of said cover (12, 64, 68) is inclined at an angle of between 45° and 75° to a horizontal plane.

6. An improved gas burner (2, 57) for cooking equipment comprising:

a supporting cup-shaped injector holder (4, 58) adapted to be fixed in a position corresponding to an opening (8) provided in a cooking hob (6) in which said burner is intended to be installed;

a flame divider (10, 60) resting on said cup-shaped support (4, 58) in such a manner as to define, with an outer circumferential rim (30) of said cup-shaped support and with a surface of said cooking hob (6) in which said burner (2, 57) is intended to be installed, a passage (32) for entry of a flow of primary air (34); and at least one sheet metal cover (12, 64, 68) removably resting on said flame divider (10, 60) and defining therewith at least one distribution chamber (42, 62, 66) for a combustion mixture of gas and the primary air, wherein said distribution chamber (42, 62, 66) is bounded by a raised band (22, 70, 76), in which a plurality of radial slots (24, 72, 78) are provided for passage of said combustion mixture, said cover (12, 64, 68) comprising a plurality of apertures (46, 74, 80) facing said radial slots (24, 72, 78) and cooperating therewith to define an inclination of flames (52, 82, 84) emerging from said apertures (46, 74, 80), and wherein said cover (12, 64, 68) comprises an inclined circumferential band (44) in which said apertures (46, 74, 80) are provided.

7. The burner as claimed in claim 6, wherein said raised band (22, 70, 76) of the flame divider (10, 60) defines a downwardly inclined side.

8. The burner as claimed in claim 7, wherein said circumferential band (44) of said cover (12, 64, 68) is inclined in conformity with said inclined side of said raised band (22, 70, 76) of the flame divider (10, 60).

9. The burner as claimed in claim 1, wherein said cover (12, 64, 68) comprises an outer edge (48) which is bent downwards to engage in a corresponding annular slot (28, 90) provided in the flame divider (10, 60).

10. The burner as claimed in claim 6, wherein said cover (12, 64, 68) presents a central flat portion (40) extending outwards into said inclined circumferential band (44), an outer edge (48) of which is bent downwards to engage in a corresponding annular slot (28, 90) provided in said flame divider (10, 60).

11. The burner as claimed in claim 9, wherein dimensions of said annular slot (90) relative to a thickness of sheet metal which forms the cover (12, 64, 68) and to a height of a downwardly bent outer edge (48) of the cover are such that, when the cover (12, 64, 68) is placed on the flame divider (10, 60), the bent outer edge (48) of the cover defines with the annular slot (90) provided in the raised band (22, 70, 76) of said flame divider (10, 60) a passage (50) for the flow of the combustion mixture intended to form a stabilization flame (54, 92).

12. The burner as claimed in claim 1, wherein the raised band (22, 70, 76) of the flame divider (10, 60), in which the radial slots (24, 72, 78) are provided, is integral with a remaining part of the flame divider (10, 60).

13. The burner as claimed in claim 1, wherein the raised band (22, 70, 76) of the flame divider (10, 60), in which the radial slots (24, 72, 78) are provided, is separate from a remaining part of the flame divider (10, 60).

14. The burner as claimed in claim 1, wherein the flame divider (60) comprises a central mixing chamber (62), with which a circular sheet metal cover (64) is associated, and an annular mixing chamber (66), with which an annular sheet metal cover (68) is associated.

15. The burner as claimed in claim 14, wherein an annular cavity is defined between said central mixing chamber (62) and said annular mixing chamber (66).

16. The burner as claimed in claim 1, wherein said cover is made of pressed enamelable sheet metal.

17. The burner as claimed in claim 1, wherein a number of apertures (46, 74, 80) of said sheet metal cover (12, 64, 68) corresponds to a number of radial slots (24, 72, 78) provided in said flame divider (10, 60).

18. The burner as claimed in claim 1, wherein said sheet metal cover (12, 64, 68) has a radial extension less than a radial extension of said flame divider (10, 60).

19. The burner as claimed in claim 1, wherein said circumferential rim (30) of said flame divider (10, 60) projects radially beyond said sheet metal cover (12, 64, 68).

20. The burner as claimed in claim 6, wherein said circumferential rim (30) of the flame divider (10, 60) is inclined at an angle corresponding to the inclined circumferential band (44) of said cover (12, 64, 68) such as to define line continuity between said cover (12, 64, 68) and an exposed portion of said flame divider (10, 60).

* * * * *